United States Patent [19]

Buscarino

[11] Patent Number: 4,982,640

[45] Date of Patent: Jan. 8, 1991

[54] GUITAR WITH IMPROVED RELEASABLE NECK JOINT CONSTRUCTION

[76] Inventor: John R. Buscarino, 8460 81st Way North, Seminole, Fla. 34647

[21] Appl. No.: 409,083

[22] Filed: Sep. 19, 1989

[51] Int. Cl.[5] ..... G10D 3/00

[52] U.S. Cl. ..... 84/293; 84/291

[58] Field of Search ..... 84/293, 291

[56] References Cited

U.S. PATENT DOCUMENTS

| | | | |
|---|---|---|---|
| 3,911,778 | 10/1975 | Martin | 84/267 |
| 4,027,570 | 6/1977 | Rendell et al. | 84/293 |
| 4,200,023 | 4/1980 | Kaman | 84/293 |
| 4,290,336 | 9/1981 | Peavey | 84/291 |
| 4,793,236 | 12/1988 | McGuire et al. | 84/293 |
| 4,856,403 | 8/1989 | Davies | 84/291 |

*Primary Examiner*—Lawrence R. Franklin
*Attorney, Agent, or Firm*—Pitts and Brittian

[57] ABSTRACT

A guitar with improved releasable neck joint construction. The guitar (10) comprises a body (12) having a forwardly facing neck engaging surface (36), and a neck (18) having a proximal end portion (20) for being secured to the body (12). The proximal end portion (20) of the neck (18) defines a rearwardly facing body engaging surface (40) for engaging the neck engaging surface (36) of the body (12). At least one mortise/tenon coupling (42) is provided for interlocking the neck (18) and body (12) at the neck engaging surface (36) and body engaging surface (40), with threaded fasteners (48) being provided for releasably securing the coupling (42) in a coupled position.

12 Claims, 2 Drawing Sheets

GUITAR WITH IMPROVED RELEASABLE NECK JOINT CONSTRUCTION

TECHNICAL FIELD

This invention relates to a guitar having an improved neck joint construction. In this particular invention the body and neck of the guitar releasably interlock through the use of a selectively disposed mortise/tenon coupling.

BACKGROUND ART

Guitars which are provided with releasably mounted necks have long been known in the art. However, due to the stresses placed on the neck of a guitar, both from the tension of the strings and manipulation by the guitar player great difficulty has been encountered in designing a releasable neck joint which will hold the neck firmly in place on the body of the guitar over an extended period of time. Conventional releasable guitar necks are generally secured with a plurality (typically four) of threaded fasteners such as screws, but lateral and axial forces on the fasteners often result in loosening of the screws with time and, thus, loosening of the neck. Moreover, the large number of screws necessary to hold the guitar neck in place can crack and otherwise undermine the strength of the wood fabricating material of the neck and/or body. In an attempt to accomplish a more secure neck joint, certain guitar constructions have provided for recessing the heel of the neck in the body of the guitar such that the body defines shoulder portions on either side of the heel which closely engage the heel. However, by bounding the neck on either side with the guitar body, access to the proximal portion of the finger board is obstructed by the body such that certain high notes can be difficult to play.

Therefore, it is an object of the present invention to provide a guitar with an improved releasable neck joint which is stronger and more durable than releasable neck joints heretofore known.

It is a further object of the present invention to provide a guitar with an improved releasable neck joint which provides better playing access to the proximal portion of the finger board of the guitar.

Still another object of the present invention is to provide a guitar with an improved releasable neck joint which allows a fewer number of threaded fasteners to be used.

Yet another object of he present invention is to provide a guitar with an improved neck joint construction which is inexpensive to manufacture and requires little or no maintenance.

DISCLOSURE OF THE INVENTION

Other objects and advantages will be accomplished by the present invention which provides a guitar with an improved releasable neck joint construction. The guitar comprises a body having a forwardly facing neck engaging surface, and a neck having a proximal end portion having a rearwardly disposed body engaging surface for engaging, and being secured to, the neck engaging surface of the guitar body. The neck engaging surface and the body engaging surface are coupled together through the use of a mortise/tenon coupling, and held in the coupled position with releasable fasteners. In the preferred embodiment, the mortise/tenon coupling includes a mortise provided in the body engaging surface of the neck, and a tenon provided on the neck engaging surface of the guitar body for being closely received in the mortise.

BRIEF DESCRIPTION OF THE DRAWINGS

The above-mentioned features of the present invention will become more clearly understood from the following detailed description of the invention read together with the drawing in which.

BEST MODE FOR CARRYING OUT THE INVENTION

A guitar with an improved neck joint construction incorporating various features of the present invention is illustrated generally at 10 in the figures. Whereas the guitar 10 illustrated in the figures depicts a guitar type and style commonly referred to as a "solid body electric" guitar, it will be recognized from the discussion which follows that the construction of the guitar of the present invention, with its improved neck joint construction, is adaptable to various types and styles of guitars, including various styles of acoustic guitars and various styles of electric and acoustic bass guitars.

Figure 2:
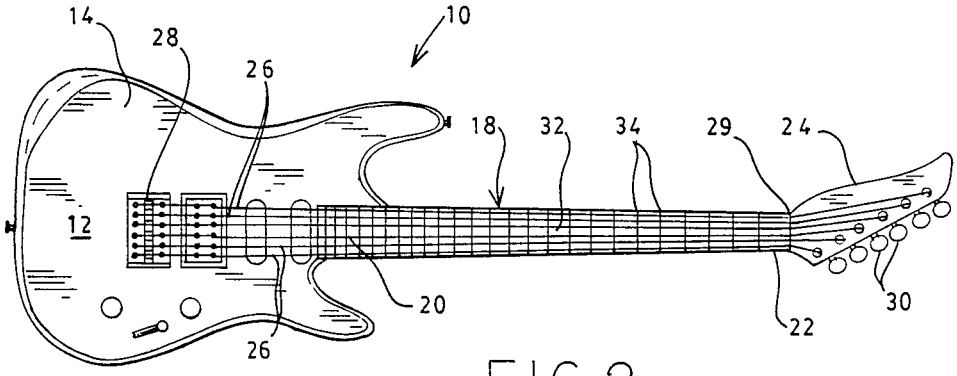
FIG. 2 illustrates a top view of a guitar of the present invention.
Figure 3:
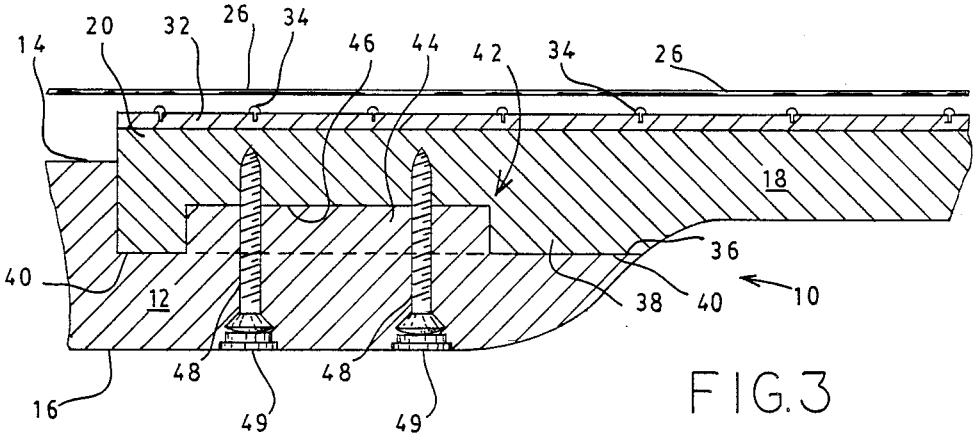
FIG. 3 illustrates a partial side elevation view, in section, of a guitar of the present invention.

The guitar 10 comprises a body 12 having a forward surface 14 and a rearward surface 16. Preferably, the body 12 is fabricated of wood. However, various fabricating materials can be utilized. Further, whereas the illustrated body 12 is depicted in FIG. 3 as being fabricated from a single piece of wood, the body need not be integrally formed, and also can define a cavity (not shown) therein such that the guitar defines what is commonly referred to as a "hollow body" guitar. As best illustrated in FIG. 2, the guitar 10 also comprises a neck 18 having a proximal end portion 20 for engaging the body 12 such that the neck 18 extends outwardly from the body. The neck 18 also defines a distal end portion 22 carrying what is commonly referred to as the head 24. As will be understood by those skilled in the art, the strings 26 of the guitar are strung from a bridge 28, mounted on the body 12, across the nut 29, to tuning machines 30 mounted on the head 24, such that the strings 26 are disposed a selected distance above the finger board 32 of the neck 18 and the frets 34 mounted thereon.

Figure 1:
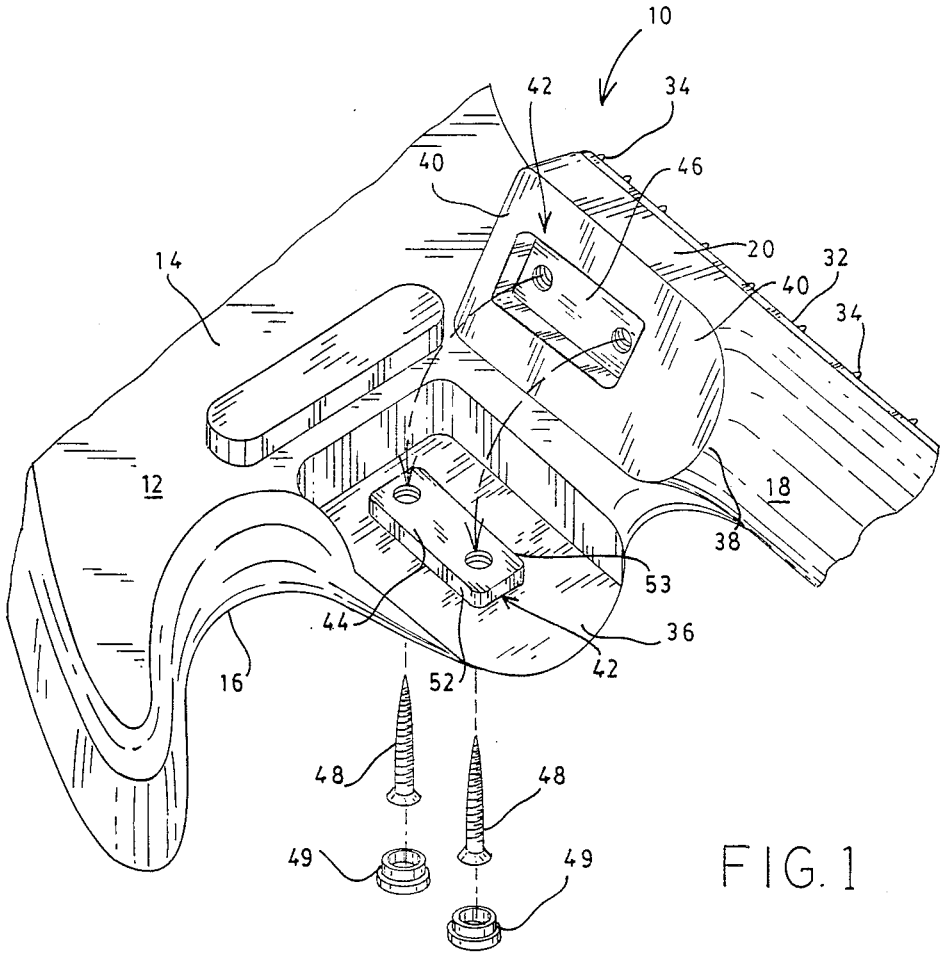
FIG. 1 illustrates a partial perspective view of a guitar of the present invention.

Referring to FIGS. 1 and 3, and the improved neck joint construction, the body 12 of the guitar 10 defines a neck engaging surface 36 for engaging the proximal end portion 20 of the neck 18. In the illustrated embodiment, the neck engaging surface 36 is recessed into the body 12. However, it will be understood that depending on the style of the guitar 10, it may not be necessary to recess the surface 36. Also, the proximal end portion 20 of the neck 18 defines a heel 38 which, in turn, defines a body engaging surface 40 for engaging the neck engaging surface 36 of the body 12, as illustrated in FIG. 3. In order to secure the surfaces 36 and 40 together, and, thus, secure the neck 18 in place, the improved neck joint construction includes a mortise/tenon coupling 42. More specifically, the coupling 42 includes a tenon 44 which projects outwardly from, and is preferably centrally disposed upon, the neck engaging surface 36. Further, a mortise 46 is provided in the body engaging surface 40 of the neck 18 for closely receiving the tenon 44. Accordingly, as the surfaces 36 and 40 come together, the body 12 and neck 18 interlock to provide a more secure coupling of neck and body.

In the preferred embodiment, the mortise/tenon coupling 42 is locked in the coupled position with one or more fasteners, such as the screws 48. As best illustrated in FIG. 3, the screws 48 are threaded through the body 12 from the rearward surface 16, through the mortise/tenon coupling, and into the heel 38 of the neck 18. Accordingly, the neck 18 can be easily removed by simply removing the screws 48. It will be noted that that the heads of the screws 48 are preferably countersunk into the body as illustrated in FIG. 3, and decorative caps 49 are provided being force fitted into the countersink openings to cover the heads of the screws 48. It will also be noted, that if releasability of the neck 18 is not desired, a suitable adhesive can be used to secure the neck in place on the body with the coupling 42 serving to enhance the strength of the engagement between neck and body.

Figure 4:
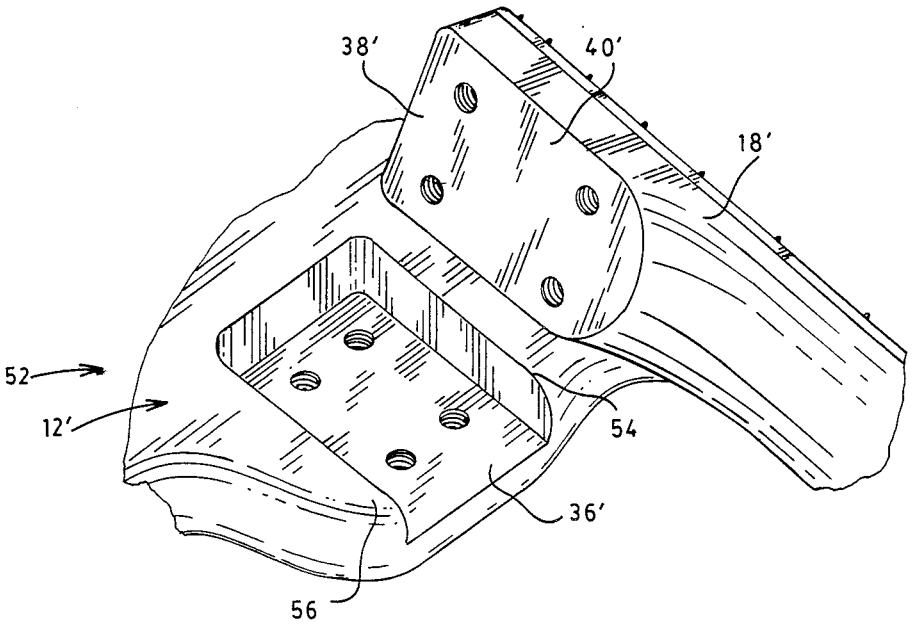
FIG. 4 (PRIOR ART)
FIG. 4 illustrates a partial perspective view of a prior art guitar.

The tenon 44, and, thus, the mortise 46, preferably define rectangular configurations such that the tenon 44 defines oppositely disposed planar sidewalls 52 and 53 which are oriented substantially parallel to the axis of the neck 18 and substantially perpendicular to the neck engaging surface 36. Resultantly, the close engagement of the sidewalls 52 and 53 with the walls of the mortise 42 serve to secure the neck 18 in the proper axial position, and prohibits the neck 18 from pivoting on the neck engaging surface 36. The advantage of this construction can be reallY seen by comparison with conventional guitar construction exemplified by the prior art guitar 52 of FIG. 4. In the construction of the guitar 52, pivoting of the neck 18' on the neck engaging surface 36' is restricted by recessing the heel 38' into the body 12' such that it is bounded on either side by the shoulder portions 54 and 56. However, the position of the shoulder 56 tends to restrict the guitar players access to the proximal portion of the finger board making certain high notes difficult to play. With the construction of the present invention, the mortise/tenon coupling 42 makes the shoulder 56 unnecessary such that the entire finger board is easily accessible. Further, the mortise/tenon coupling prohibits axial movement of the neck 18 on the surface 36.

It will also be noted that certain prior art guitars have eliminated the shoulder 56 and relied upon four (4) or more screws or fasteners to prohibit movement of the neck 18 relative to the surface 36, but this places great lateral stress on the screws which can result in eventual loosening of the screws, or, in some cases, shearing of the screws at the point where the surfaces 36 and 40 meet, in turn, resulting in the loosening of the neck 18. Moreover, placing a large number of screws in the wood of the body and neck can undermine the strength of the wood fabricating material. With the construction of the present invention, lateral stress normally borne by the screws is borne instead by the mortise/tenon coupling such that only two screws 48 are necessary to lock the neck in place.

Whereas in the illustrated embodiment of FIGS. 1 and 3, the mortise 46 is provided in the body engaging surface 40 and the tenon 44 is provided on the neck engaging surface 36, it will be understood that the positions of the mortise and tenon can be reversed, and the mortise 46 provided in the surface 36 and the tenon 44 provided on the surface 40. However, placement of the tenon 44 on the surface 36 allows the body 12 to be thinner proximate the surface 36 such that the body 12 does not interfere with access to the proximal end portion of the finger board 32. It will also be recognized that more than one mortise/tenon coupling can be provided if desired.

While a preferred embodiment has been shown and described, it will be understood that there is no intent to limit the invention to such disclosure, but rather it is intended to cover all modifications and alternate constructions falling within the spirit and scope of the invention as defined in the appended claims.

I claim:

1. A guitar with improved releasable neck joint construction, said guitar comprising:

a body having a forwardly facing neck engaging surface;

a neck having a forwardly facing finger board surface and defining a longitudinal axis extending from a distal end portion to a proximal end portion, said proximal end portion of said neck defining a rearwardly facing body engaging surface for engaging said neck engaging surface of said body; and securing means for securing said proximal end portion of said neck to said body, said securing means including at least one mortise/tenon coupling disposed at the junction of said neck engaging surface and said body engaging surface, said coupling including a tenon defining a sidewall perimeter, and said coupling being provide with a mortise defining a tenon engaging closed sidewall perimeter for substantially flush engagement with and about said outer sidewall perimeter of said tenon whereby said substantially flush engagement between said mortise and tenon prohibits both lateral and longitudinal movement of said neck with respect to said body.

2. The guitar of claim 1 wherein said securing means for securing said neck to said body further includes at least a pair of threaded fasteners threaded through said body and into said neck.

3. The guitar of claim 2 wherein said threaded fasteners are threaded through said mortise/tenon coupling.

4. The guitar of claim 1 wherein said mortise/tenon coupling includes a tenon provided on said neck engaging surface of said body, and a mortise provided in said body engaging surface of said neck for closely receiving said tenon.

5. The guitar of claim 4 wherein said tenon is substantially centrally disposed on said neck engaging surface.

6. The guitar of claim 4 wherein said tenon defines a rectangular solid configuration having oppositely disposed sidewalls, each oriented in a plane substantially parallel to said axis of said neck and substantially perpendicular to said neck engaging surface, and oppositely disposed end walls, each oriented in a plane substantially perpendicular to said axis of said neck.

7. The guitar of claim 1 wherein said tenon defining a rectangular solid configuration defining oppositely disposed sidewalls each oriented in a plane substantially parallel to said axis of said neck, and oppositely disposed end walls each oriented in a plane substantially perpendicular to said axis of said neck, and wherein said mortise defines oppositely disposed sidewall surfaces for engaging said sidewalls of said tenon and oppositely disposed end wall surfaces for engaging said end walls of said tenon.

8. A guitar with improved releasable neck joint construction, said guitar comprising:

a neck having a forwardly facing finger board surface and defining a longitudinal axis extending from a distal end portion to a proximal end portion, said proximal end portion of said neck defining a rearwardly facing body engaging surface provided with at least one mortise, said mortise having a plurality of planar walls joined to define a closed tenon engaging perimeter; and a body having a forwardly facing neck engaging surface, said neck engaging surface being provided with at least one tenon projecting therefrom for being closely received in said mortise, said tenon having a plurality of planar walls defining an outer perimeter for substantially flush engagement with said tenon engaging perimeter of said neck.

9. The guitar of claim 8 wherein said tenon defining a rectangular solid configuration defining oppositely disposed sidewalls each oriented in a plane substantially parallel to said axis of said neck, and oppositely disposed end walls each oriented in a plane substantially perpendicular to said axis of said neck, and wherein said mortise defines oppositely disposed sidewall surfaces for engaging said sidewalls of said tenon and oppositely disposed end wall surfaces for engaging said end walls of said tenon.

10. The guitar of claim 8 wherein said tenon is substantially centrally disposed on said neck engaging surface.

11. A guitar with improved releasable neck joint construction, said guitar comprising:

a neck having a forwardly facing finger board surface and defining a longitudinal axis extending from a distal end portion to a proximal end portion, said proximal end portion of said neck defining a rearwardly facing body engaging surface provided with at least one tenon projecting therefrom, said tenon having a plurality of planar walls defining an outer perimeter; and a body having a forwardly facing neck engaging surface, said neck engaging surface being provided with at least one mortise for closely receiving said tenon, said mortise having a plurality of planar walls joined to define a closed, tenon engaging perimeter for substantially flush engagement with said outer perimeter of said tenon.

12. The guitar of claim 11 wherein said tenon defining a rectangular solid configuration defining oppositely disposed sidewalls each oriented in a plane substantially parallel to said axis of said neck, and oppositely disposed end walls each oriented in a plane substantially perpendicular to said axis of said neck, and wherein said mortise defines oppositely disposed sidewall surfaces for engaging said sidewalls of said tenon and oppositely disposed end wall surfaces for engaging said end walls of said tenon.

* * * * *